US007588424B2

(12) United States Patent
Mrzyglod

(10) Patent No.: US 7,588,424 B2
(45) Date of Patent: Sep. 15, 2009

(54) LINEAR COMPRESSOR UNIT

(75) Inventor: Matthias Mrzyglod, Ulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 375 days.

(21) Appl. No.: 10/531,847

(22) PCT Filed: Oct. 16, 2003

(86) PCT No.: PCT/EP03/11494

§ 371 (c)(1),
(2), (4) Date: Apr. 18, 2005

(87) PCT Pub. No.: WO2004/038221

PCT Pub. Date: May 6, 2004

(65) Prior Publication Data

US 2006/0153711 A1 Jul. 13, 2006

(30) Foreign Application Priority Data

Oct. 22, 2002 (DE) ..... 102 49 215

(51) Int. Cl.

| | |
|---|---|
| ***F04B 39/00*** | (2006.01) |
| ***F04B 53/00*** | (2006.01) |
| ***F02M 35/12*** | (2006.01) |
| ***F01N 1/20*** | (2006.01) |

(52) U.S. Cl. ..... 417/312; 181/229; 181/268; 181/403

(58) Field of Classification Search ..... 181/229, 181/267, 268, 275, 281, 403
See application file for complete search history.

(56) References Cited

U.S. PATENT DOCUMENTS

| | | | | |
|---|---|---|---|---|
| 1,496,508 | A * | 6/1924 | Yoakum et al. | 181/267 |
| 4,420,063 | A * | 12/1983 | Bohlmann et al. | 181/229 |
| 4,534,861 | A * | 8/1985 | Wedemeyer et al. | 210/167.02 |
| 5,355,108 | A | 10/1994 | Morinigo et al. | |
| 5,772,410 | A | 6/1998 | Chang | |
| 5,952,625 | A * | 9/1999 | Huff | 181/265 |
| 6,273,688 | B1 * | 8/2001 | Kawahara et al. | 417/417 |
| 6,328,544 | B1 | 12/2001 | Kawahara et al. | |
| 6,398,523 | B1 * | 6/2002 | Hur et al. | 417/417 |

FOREIGN PATENT DOCUMENTS

| | | | |
|---|---|---|---|
| DE | 24 14 961 | A1 | 10/1975 |
| EP | 509660 | A1 * | 10/1992 |
| JP | 06-0 26 448 | A | 2/1994 |

OTHER PUBLICATIONS

International Search Report for PCT/EP2003/011494.

* cited by examiner

*Primary Examiner*—Devon C Kramer
*Assistant Examiner*—Philip Stimpert
(74) *Attorney, Agent, or Firm*—James E. Howard

(57) ABSTRACT

A linear compressor unit including a reciprocating magnet driven by an electromagnetic alternating field. The magnet drives a piston reciprocatingly in a cylinder in a module casing, which casing also encloses a buffer volume. The cylinder is mounted in the casing so that it can oscillate. The cylinder includes an inlet opening coupled to an inlet passage in the module casing lying opposite to one another but without making contact with each other and forming a passage to the buffer volume. At least one restrictor element is located in the passage to dampen sound of the unit.

10 Claims, 2 Drawing Sheets

LINEAR COMPRESSOR UNIT

The invention relates to a linear compressor unit which can especially be used to compress a coolant in a refrigerating device such as a refrigerator, a freezer or the like.

Reciprocating-piston compressors driven by rotary motors are conventionally used in domestic refrigerating devices. For domestic usage it is very important that these compressors only generate minimal running noise. An important source of this noise is the intermittent suction of the coolant to be compressed, caused by the forward and backward movement of the piston. This intermittent suction causes pulsations which must be reduced by corresponding damping devices. A common design principle for this purpose is to pass the flow of gaseous coolant via chambers which are constructed, for example, as Helmholtz resonators or the like, so that the pulsations are strongly damped and do not reach the outside. These chambers are usually built directly onto the pump of the compressor. This pump is enclosed in a module casing for noise damping and insulation. Between the inlet of the chambers and the module casing of the compressor, there is a small spacing which allows the passage of coolant into the buffer volume of the casing module surrounding the pump.

Recently, so-called linear compressors have been developed which dispense with a rotary motor to drive the compressor piston and instead of this, drive this piston directly by a magnet which can be driven to move linearly back and forth in an alternating electromagnetic field. As a result of this driving principle, the cylinder in a linear compressor is subject to strong vibrations excited by the forward and backward movement of the magnet and the piston coupled thereto.

If an attempt is made to apply the construction principle known from the building of rotary-motor-driven compressors, as a result of which an inlet opening of the cylinder and an inlet passage of the module casing containing the cylinder lie opposite one another without making contact, forming a passage to the buffer volume, to the building of linear compressor units, the problem arises that the unavoidable oscillatory movement of the linear compressor unit modulates the cross-section of the passage to the buffer volume at the resonance frequency of the movable piston and in this way, tends to increase the noise production rather than dampen it.

The object of the present invention is to provide a linear compressor unit with an encapsulated cylinder in which the generation of noise by modulation of the passage cross-section to the buffer volume is effectively limited.

The object is solved by a linear compressor unit having the feature of claim 1. The restrictor element in the passage prevents the excitation of resonances in the buffer volume and therefore excessive noise.

The restrictor element is preferably formed by walls which are attached to the module casing or to the cylinder and which intermesh. The walls can have an arbitrary suitable shape in order to bring about a pressure drop in gas flowing back and forth between the inlet opening and the buffer volume as a result of friction at said walls. Walls which surround the inlet opening or the inlet passage in a ring shape or concentrically are preferable.

The cylinder itself preferably has one or a plurality of sound-damping chambers between its inlet opening and a working chamber which receives the piston. Thus, intensive pressure thrusts produced by the piston in the working chamber are partly intercepted before they reach the passage to the buffer volume.

A further appropriate sound-damping measure is to insert, in the inlet passage of the module casing, a sound-damping chamber through which the medium to be compressed flows.

This chamber can be attached directly to the wall of the module casing and have a flat cylindrical shape through which the inlet passage runs along the cylinder axis of the chamber.

The oscillatory holder of the cylinder is preferably formed by an outlet pipe through which the compressed medium leaves the cylinder. The outlet pipe is preferably guided helically around the cylinder chamber. The magnet which drives the forward and backward movement of the piston can especially be arranged in an axial extension of the piston or around the piston in a ring shape.

Further features and advantages of the invention are obtained from the following description of exemplary examples with reference to the appended figures. In the figures.

Figure 1:
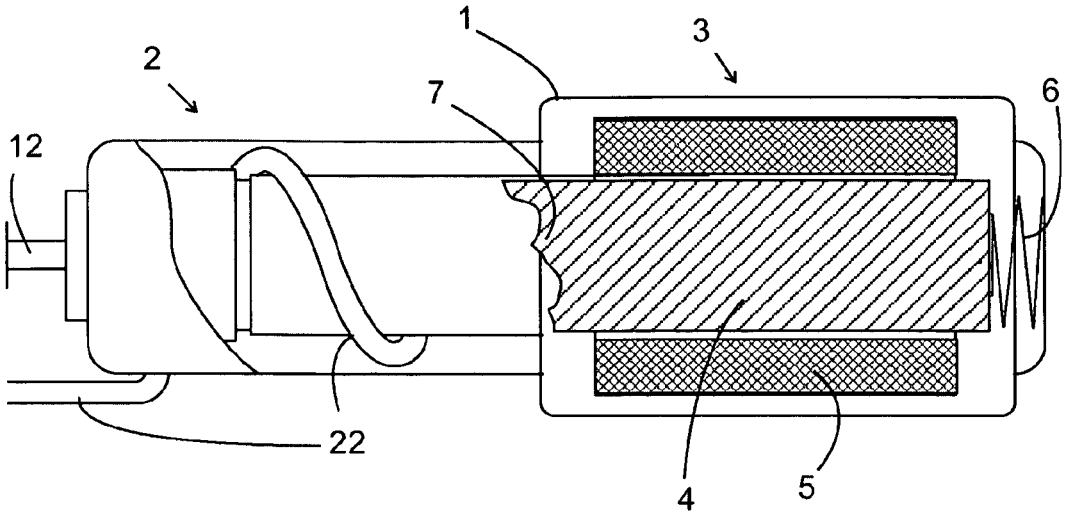
FIG. 1 is a schematic partial section through a first embodiment of the linear compressor unit according to the invention.
Figure 2:
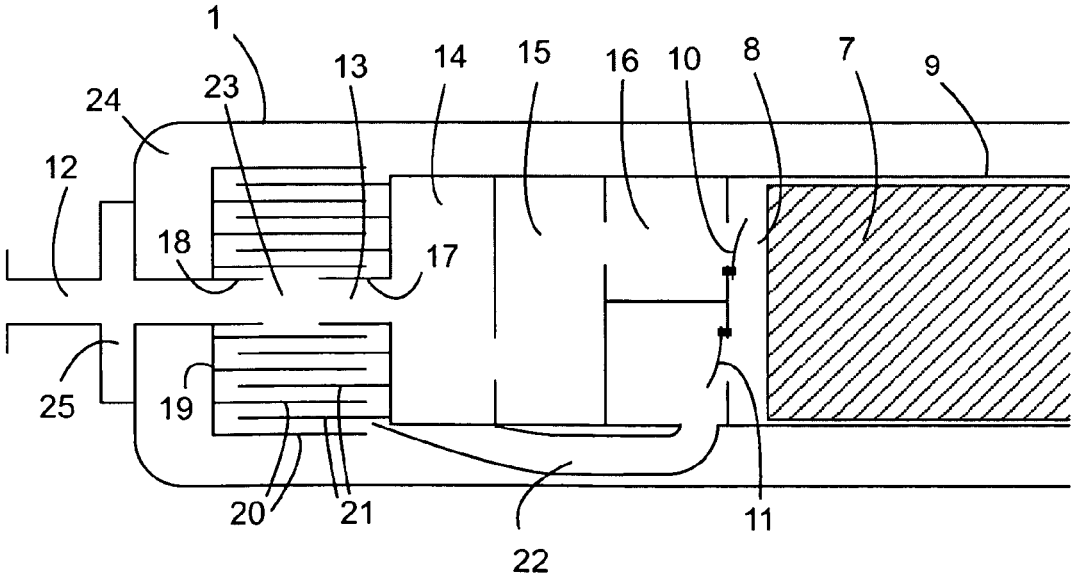
FIG. 2 is a detailed section through the head region of the linear compressor unit from FIG. 1.

The linear compressor unit shown in FIG. 1 comprises a hermetically sealed metal module casing 1, which accommodates a pumping section 2 and a driving section 3 of the compressor unit. The driving section 03 shown in cross-section substantially comprises a bar-shaped permanent magnet 4, which is arranged in the interior cavity of a coil 5 such that it can be moved in the longitudinal direction. A restoring spring 6, in this case in the form of a helical spring, presses the magnet 4 in the direction of the pumping section 2. As a result of an alternating current applied to the coil 5, an alternating magnetic field can be generated in its interior which excites the magnet 4 to move back and forth along the axis of the coil 5.

Fixedly mounted on the magnet 4 is a piston 7 which engages in a working chamber 8 of a cylinder 9 and can be displaced therein by the movement of the magnet. On a wall of the working chamber 8 located opposite to the piston 7 two openings are each provided with a valve 10, 11. The valves 10,11 are shown here as flap or blade valves but it is understood that any type of valve which only allows medium to flow in one direction—into the working chamber 8 in the case of the valve 10 and out of said working chamber in the case of the valve 11—can be used.

Medium to be compressed reaches the working chamber 8 via an inlet passage 12 in the form of a pipe section which crosses the module casing 1 and is fixedly anchored therein, an inlet opening 13 of the cylinder 9 and a sequence of chambers 14, 15, 16 which are mounted in the case of the cylinder 9 before the working chamber 8.

The inlet opening 13 of the cylinder 9 is located at the end of a pipe connecting piece 17 which is located at a distance from a front wall of the cylinder 9 in a direction parallel to the direction of movement of the magnet 4 and the piston 7. This pipe connecting piece 17 lies in alignment opposite to a second pipe connecting piece 18 which forms the portion of the inlet passage 12 engaging into the interior of the module casing 1.

The pipe connecting piece 18 carries a radially distant flange 19 on which a plurality of cylindrical walls 20 are arranged concentrically to the longitudinal axis of the inlet passage 12. Corresponding walls 21 with suitably staggered diameters are attached to the front side of the cylinder 9 and engage in each case between two of the walls 20.

Compressed medium leaves the working chamber 8 via an outlet pipe 22 which is affixed at one end to the cylinder 9, runs helically around the cylinder 9 and finally crosses through the wall of the module casing 1. This outlet pipe 22 at the same time forms a suspension of the cylinder 9 in the module casing 1 which allows oscillating movements of the cylinder 9, especially in the longitudinal direction.

During operation of the compressor unit, with every movement of the piston 7 to the left in the figure, medium contained in the working chamber 8 is compressed and escapes through the outlet valve 11 as soon as the pressure in the working chamber 8 exceeds that in the outlet pipe 22. In this case, the piston 7 exerts a pressure directed towards the left in the figure on the cylinder 9, to which the cylinder can yield a little as a result of its elastic suspension. During this movement of the piston 7 the walls 20 and 21 are displaced towards one another and a gap between the end of the pipe connecting piece 18 and the inlet opening 13 of the cylinder 9 becomes narrower. As a result of this mobility, the transfer of the loud knocking noises which the piston 7 causes at its left reversal point, to the module casing 1 and thus into the surroundings of the compressor unit is avoided.

When the piston 7 is pulled to the right by the magnet 4 and the working chamber 8 becomes larger again, an underpressure is formed therein which on the one hand results in fresh medium being sucked in via the inlet passage 12 and on the other hand results in the cylinder 9 following the piston 7 a little far to the right. The broadening of the gap 23 resulting therefrom is not so large however that the walls 20, 21 come out of engagement as a result. The intermeshing walls 20, 21 thus act as a restrictor element which damps the outflow of medium from the buffer volume 24 into the working chamber 8 during the expansion phase of the working chamber 8 and correspondingly damps an inflow of the medium back into the buffer volume 24 via the inlet passage 12 in the compression phase of the working chamber 8. Thus, even when the working frequency of the linear compressor unit, i.e. the oscillation frequency of the magnet 4, coincides with the resonance frequency of the buffer volume 24, pressure oscillations of the buffer volume 24 are effectively damped and their amplitude is kept small. Thus, one of the components which contributes to the operating noise of a linear compressor unit is effectively suppressed.

The chambers 14, 15, 16 of the cylinder 9 likewise have sound-damping functions. They are executed in a fashion known per se from sound damping technology as Helmholtz resonators.

As a further measure to damp the operating noise of the compressor unit, a further sound-damping chamber 25 is inserted in the inlet passage 12 of the module casing 1. This chamber 25 of which one wall is formed by the module casing 1 itself, has a flat-cylindrical form wherein the inlet passage 12 crosses the chamber 25 along its cylinder axis. The chamber 25 also acts a Helmholtz resonator with an inlet opening which extends over the entire circumference of the inlet passage 12 and is thus particularly effective.

Figure 3:
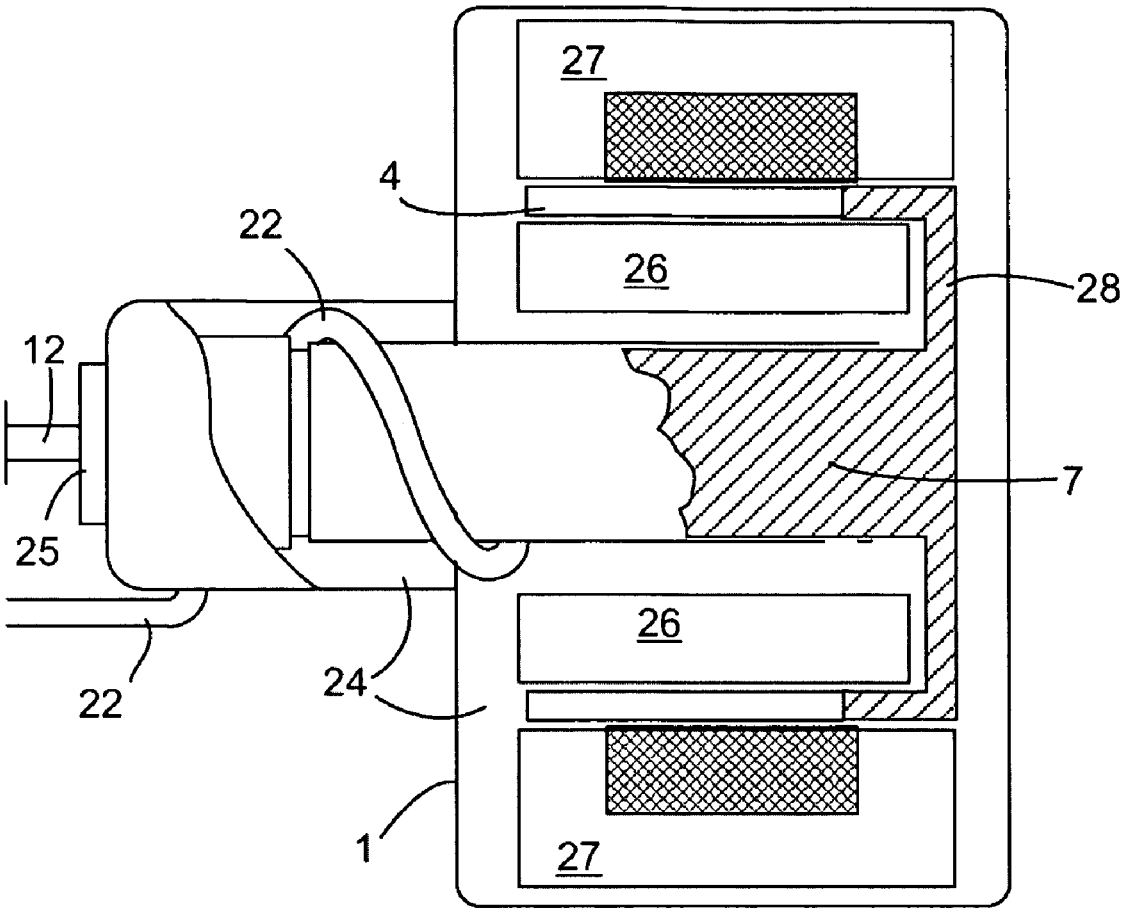
FIG. 3 is a section through a second embodiment of the linear compressor unit.

FIG. 3 shows a second embodiment of the linear compressor unit which differs from that in FIG. 1 by the design of its driving section 3. The pumping sections 2 of both embodiments are identical. Whereas in the embodiment in FIG. 1, the permanent magnet 4 is arranged in an axial extension of the piston 7, in the case shown in FIG. 3 it surrounds the piston 7 in a ring shape and is fixedly connected thereto by a flange 28 or individual radially oriented supporting arms. This annular magnet 4 is surrounded externally by a coil 5 which can excite it to oscillate as a result of an alternating magnetic field. Effective coupling of the magnetic field of the coil to the magnet 4 is provided by two sheet-metal packings 26, 27 which are each arranged in an annular intermediate space between the magnet and the cylinder, maintaining a small air gap towards the magnet 4, or externally surrounding the magnet 4 and the coil 5 in a ring shape.

The invention claimed is:

1. A linear compressor unit, comprising:

an electromagnetic alternating field surrounding at least a portion of a cylinder;

a magnet located in said electromagnetic alternating field in said cylinder, said magnet displaceable back and forth in said electromagnetic alternating field;

a piston located in said electromagnetic alternating field in said cylinder drivingly connected to said magnet;

a buffer volume;

a module casing which encloses said cylinder and said buffer volume;

said cylinder mounted in said module casing so that said cylinder can oscillate in said module casing;

said module casing including an inlet passage for media to be compressed;

said cylinder including an inlet opening lying opposite said inlet passage without making contact therewith;

a passage to said buffer volume formed between said inlet opening and said inlet passage; and at least one sound restrictor element located in said buffer volume passage, said sound restrictor element including a plurality of generally cylindrical walls, with a first group of walls attached to said module casing and a second group of walls attached to said cylinder for generally reciprocal relative motion between said first group of walls and said second group of walls with said first group of walls being intermeshed with said second group of walls, said first group of walls and said second group of walls forming a pathway, the pathway having a first run and a second run, the first run of the pathway extending from said passage to said buffer volume to a first change of direction portion communicating the first run with the second run with one surface of said first group of walls delimiting one side of the first run of the pathway and one surface of said second group of walls delimiting an opposite side of the first run of the pathway and the second run extending from the first change of direction portion to a second change of direction portion with another surface of said first group of walls delimiting one side of the second run of the pathway and another surface of said second group of walls delimiting an opposite side of the second run of the pathway, the pathway guiding media to be compressed that enters the pathway via said passage, moves in a first direction along the first run of the pathway, undergoes a change in direction while passing through the first change of direction portion, moves in a second direction along the second run of the pathway, and thereafter undergoes another change in direction while passing through the second change of direction portion.

2. The linear compressor unit according to claim 1, including said intermeshing walls are formed in a ring shape and surround at least one of said inlet opening and said inlet passage.

3. The linear compressor unit according to claim 1, including said cylinder including a chamber for receiving said piston and at least one sound-dampening chamber through which said medium to be compressed flows, said sound-dampening chamber arranged between said inlet opening of said chamber and said piston chamber.

4. The linear compressor unit according to claim 1, including at least one sound-dampening chamber through which said medium to be compressed flows located in said inlet passage of said module casing.

5. The linear compressor unit according to claim 4, including said sound-dampening chamber is formed in a flat-cylindrical shape with a cylindrical axis opening and said inlet passage of said module casing is substantially aligned therewith.

6. The linear compressor unit according to claim 1, said cylinder mounted for oscillation in said module casing by a cylinder outlet pipe.

7. The linear compressor unit according to claim 6, including said outlet pipe is formed helically around said cylinder.

8. The linear compressor unit according to claim 1, including said magnet is formed as an axial extension of said piston.

9. The linear compressor unit according to claim 1, including said magnet is formed as a ring shaped body at least partially surrounding said piston and connected thereto at one end of said piston.

10. The linear compressor unit according to claim 1, said cylinder mounted for oscillation in said module casing by a cylinder outlet pipe formed helically around said cylinder.

* * * * *

UNITED STATES PATENT AND TRADEMARK OFFICE

CERTIFICATE OF CORRECTION

PATENT NO. : 7,588,424 B2
APPLICATION NO. : 10/531847
DATED : September 15, 2009
INVENTOR(S) : Matthias Mrzyglod It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 478 days.

Signed and Sealed this

Twenty-first Day of September, 2010

David J. Kappos

David J. Kappos
*Director of the United States Patent and Trademark Office*